United States Patent [19]

Nash, Jr.

[11] 4,373,313

[45] Feb. 15, 1983

[54] WATER-TIGHT RIGID STRUCTURAL PANEL

[76] Inventor: Edgar M. Nash, Jr., 32814 Maverick Dr., Porterville, Calif. 92357

[21] Appl. No.: 171,103

[22] Filed: Jul. 22, 1980

[51] Int. Cl.[3] ..... E04C 2/32

[52] U.S. Cl. ..... 52/397; 52/281; 52/398; 52/586; 52/592; 52/799; 52/807; 52/DIG. 6

[58] Field of Search ..... 52/785, 481, 806, 824, 52/825, 826, 779, 393, 403, 807, 808, 821, 397, 398, 586, 592, DIG. 6, 799; 428/45, 69, 71, 72, 192

[56] References Cited

U.S. PATENT DOCUMENTS

| | | | |
|---|---|---|---|
| 1,476,746 | 12/1923 | Williams | 52/173 |
| 3,147,336 | 9/1964 | Mathews | 52/809 |
| 3,793,789 | 2/1974 | Greenameyer | 52/806 |

FOREIGN PATENT DOCUMENTS

| | | | |
|---|---|---|---|
| 1165670 | 10/1958 | France | 52/403 |

*Primary Examiner*—John E. Murtagh
*Attorney, Agent, or Firm*—Christie, Parker & Hale

[57] ABSTRACT

A composite structural panel having enhanced load-carrying capacity. The composite panel has a pair of planar panels separated by and bonded to a uniform elastically compressible boundary strip. The boundary strip defines a central core area between the planar panels that includes a core material bonded to each of the planar panels. The thickness of the core is less than the thickness of the boundary strip so that the planar panels are drawn relatively closer together. A compressive force results from the planar panels being urged relatively closer together such force being applied to the boundary strip. An adhesive bonds the planar panels to the boundary strip and in combination with the compressive force renders the central core area essentially impervious to moisture.

A plurality of load-bearing and load-transferring clips are secured to the perimetrical edge of a planar panel and the boundary strip. The clips provide a seat for structural framing members and transfer the structural loads from the planar panels to the framing members.

The central core area includes insulation for providing enhanced insulation properties to the composite panel.

11 Claims, 8 Drawing Figures

Fig. 5
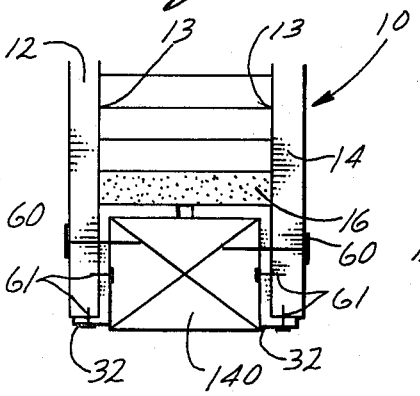
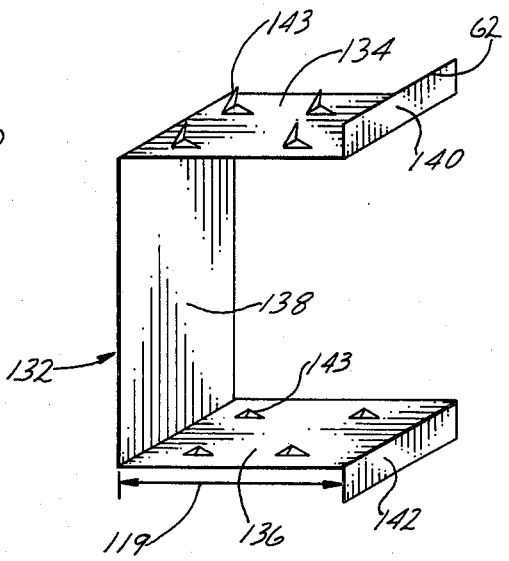
Fig. 6
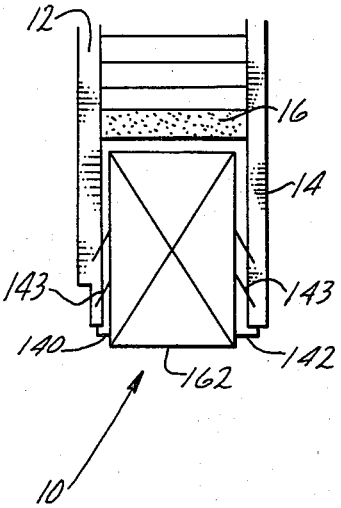
Fig. 7
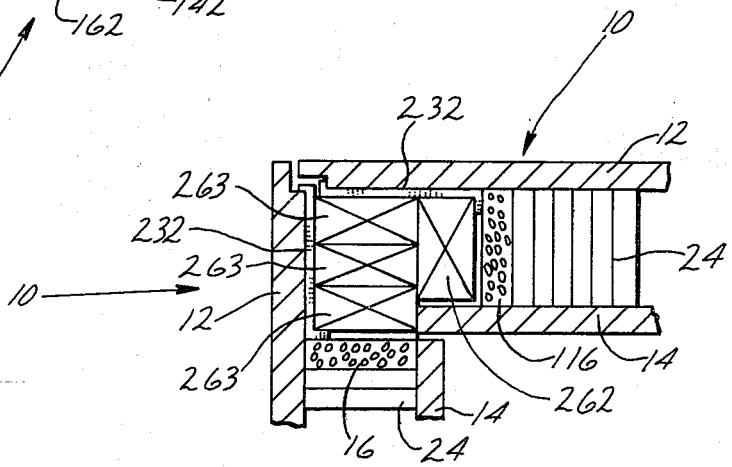
Fig. 8

WATER-TIGHT RIGID STRUCTURAL PANEL

BACKGROUND OF THE INVENTION

The invention relates to construction panels and more specifically to composite panels being impervious to moisture and having relatively high load-bearing capacity.

Construction panels are presently available that possess some degree of load-carrying capacity. Typically, the panels are formed of either single planar sheets or in a sandwich-type construction whereby two planar sheets are separated by a plurality of uniformly sized partitions that define a panel core area. The panels may be filled with insulating material for providing the panels with improved insulation properties.

Other panels include sound proofing features, such panels finding application where sound and noise transmission is to be minimized. Thus, the prior-art panels may be characterized typically as facing panels rather than structural panels.

Additionally, the panels of the prior art are not impervious to water and moisture. The composite panels formed in the sandwich-type structure previously described are moisture sensitive so that moisture originating from any of a number of sources, such as rain, is capable of entering the core area of such panels causing a deterioration of the materials contained within the core such as insulation as well as causing warpage and bulging of the panels. Thus, none of the presently-available panels, have enhanced load-carrying capacity while being impervious to moisture.

The problems and deficiencies of the prior art panels are addressed and solved by applicant's invention. Applicant provides a structural panel having enhanced load-carrying capacity, the panel having a central core area that is essentially impervious to moisture.

SUMMARY OF THE INVENTION

The present invention contemplates a composite structural panel for securement between structural framing members. The composite panel has a pair of essentially planar panels separated by and bonded to a uniform, elastically deformable boundary strip. The boundary strip is positioned a predetermined distance inward from the perimeter of the planar panels. The boundary strip defines a central core area between the panels, and the boundary strip has a thickness for defining a distance between the panels at a point of contact with the boundary strip.

A core located in the central core area is secured to each of the panels. The length of the core measured between the panels is somewhat less than the thickness of the strip means. The planar panels are thereby urged relatively closer together and causing a compressive force to be exerted by the panels on the strip means. The panels are bonded to the boundary strip by means of an adhesive. The compressive force in combination with the adhesive forms a moisture-tight seal between the planar panels and boundary strip rendering the central core area essentially impervious to moisture.

As a feature of the invention, the composite panel includes a plurality of clips secured to a planar panel between the panel's perimetrical edge and the boundary strip. The clips are formed of rigid material and form a seat for structural framing members. The clips provide load bearing and load transferring from the framing members to the composite panel.

As yet another feature of the invention, the central core area includes insulation preferably in a particulate composition for providing insulating properties to the composite panel.

As a still further feature, the boundary strip is compressively and elastically deformable such that application of compressive forces causes the boundary strip to deform wherein said boundary strip attains a thickness equal to the length of the honeycomb.

BRIEF DESCRIPTION OF THE DRAWINGS

FIG. 5 is a partial cross-sectional view taken along lines 5—5 of FIG. 4;

FIG. 6 is a perspective view of an alternate embodiment of the clips of FIG. 1;

FIG. 7 is a cross-sectional view of a vertically oriented composite panel having a clip as shown in FIG. 6 and mounted on a horizontal framing member; and FIG. 8 is a cross-sectional view of two composite panels oriented orthogonal to each other for forming a structural corner.

DETAILED DESCRIPTION

Figure 1:
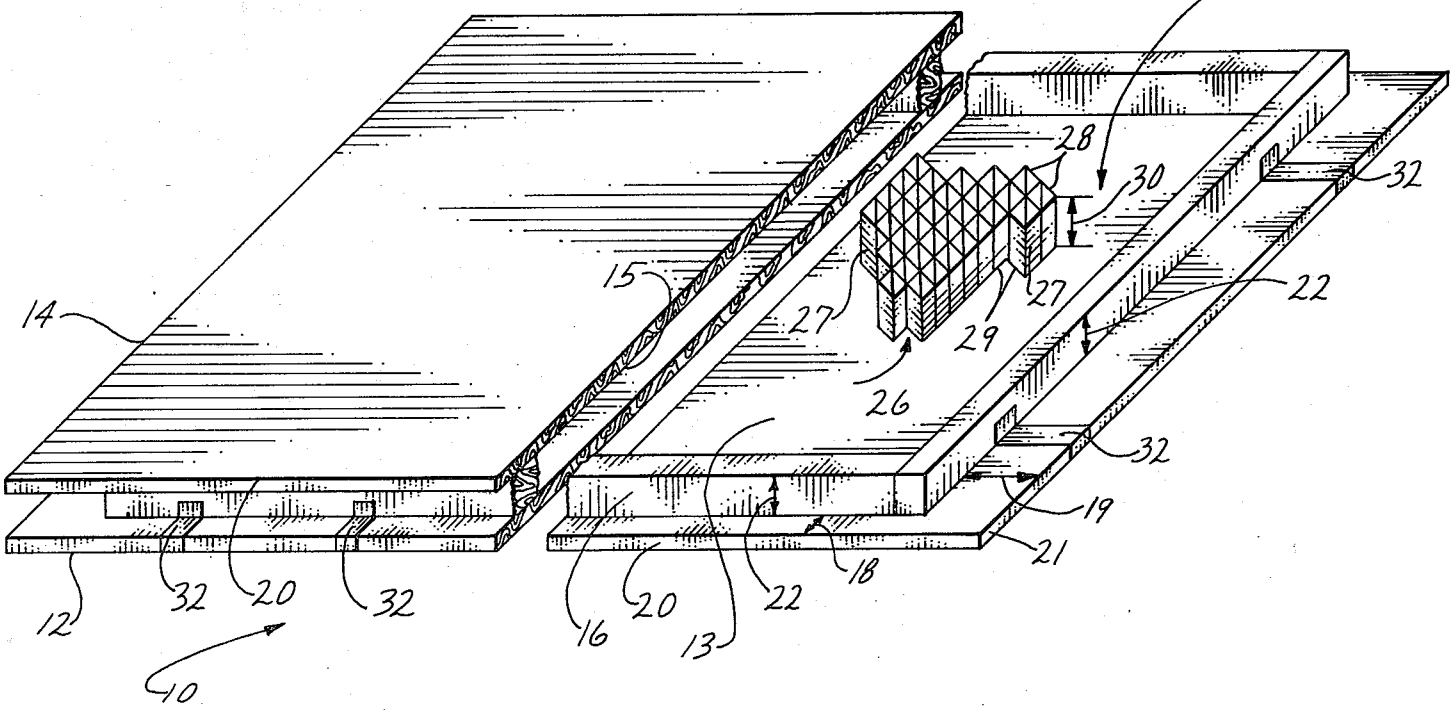
FIG. 1 is a partial cut away perspective view of a composite panel according to the invention.

Referring now to FIG. 1, there is shown in partial cross-sectional, perspective view the composite panel of the herein-described invention with a portion of the composite panel removed for showing an interior portion thereof. The composite panel 10 has a pair of essentially planar panels 12 and 14 separated by and bonded to a boundary strip 16.

Preferably, the panels 12 and 14 are of rectangular shape for adaptability to conventional construction techniques. However, it is understood by those skilled in the art that the geometrical shapes of the panels are not restricted to rectangular and may be of any shape in conformance with specific construction requirements. The boundary strip 16 is located at predetermined distances 18 and 19 from the perimetrical edges 20 and 21 respectively of the panels 12 and 14. The boundary strip 16 has a uniform width 22 which maintains the panels 12 and 14 spaced apart a predetermined distance 22 at the region of contact between the panels and the boundary strip.

The boundary strip 16 defines a central core region 24 lying between the panels 12 and 14. The central core region 24 exists over a major portion of the panel area. Preferably, such major portion comprises about 95% of the panel area.

The panels 12 and 14 are bonded to the boundary strip 16 by any one of a number of commercially-available bonding agents and adhesives such as, for example, moisture-repelling wood glue.

A core material 26 is disposed preferably throughout the central core area and in contact with the inwardly oriented panel faces of the respective panels.

As shown in FIG. 1, the core material 26 comprises a honeycomb structure (hereinafter honeycomb structure 26) having walls 27 lying in a plane essentially normal to the faces of the panels 12 and 14. The upper edges 28 and the lower edges 29 (as shown in FIG. 1) of the honeycomb structure 26 are bonded to the respective faces 13 and 15 of the panels 12 and 14, respectively. The bonding material may be any one of a number of commercially-available, high strength adhesives. The honeycomb width 30 defined as the distance between the honeycomb's upper and lower edges 28 and 29 is marginally smaller than the width 22 of the boundary strip 16. For example, in a presently-preferred embodiment, the width 30 is approximately one-eighth inch smaller than the boundary strip width 22. At the time of manufacture, the composite panel is drawn between two pinch rollers for urging the panels relatively closer together and causing the panel faces to come in contact with and thus become bonded to the respective edges of the honeycomb structure 26. Due to the high-strength adhesive, the panel faces remain in an urged-together condition. By virtue of this urged-together condition, a compressive force is exerted by the panel faces 13 and 15 on the boundary strip 16.

Figure 2:
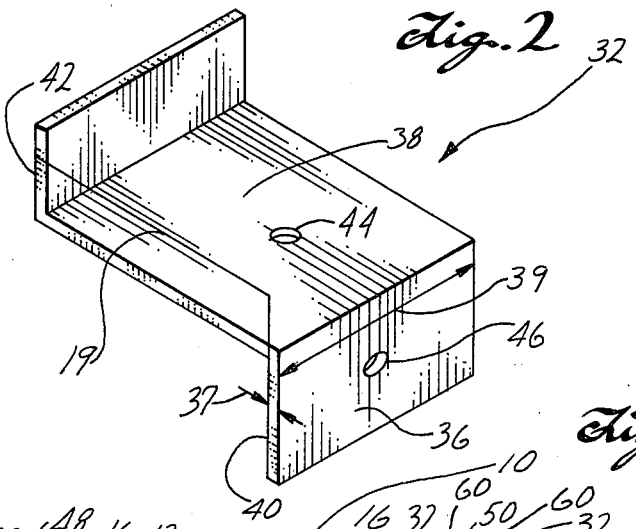
FIG. 2 is an perspective view of a clip shown in FIG. 1.

A plurality of clips 32, placed in a spaced-apart relation, are secured to at least one face 13 or 15 of the panels 12 and 14. The clips 32 (better shown in perspective view in FIG. 2) are essentially Z-shaped having parallel leg portions 34 and 36 and a central interconnecting leg portion 38 from which the legs 34 and 36 depend in opposing directions. The inner surface 40 of leg 36 is adapted for abutting contact with either perimetrical edge 20 or 21 of panels 12 or 14. The outer surface 42 of leg 34, as shown in FIG. 1, may be in abutting contact with the boundary strip 16. Typically, however, outer surface 42 is placed in relation to the boundary strip 16 such that no loads are transferred from the clips 32 to the boundary strip.

Figure 3:
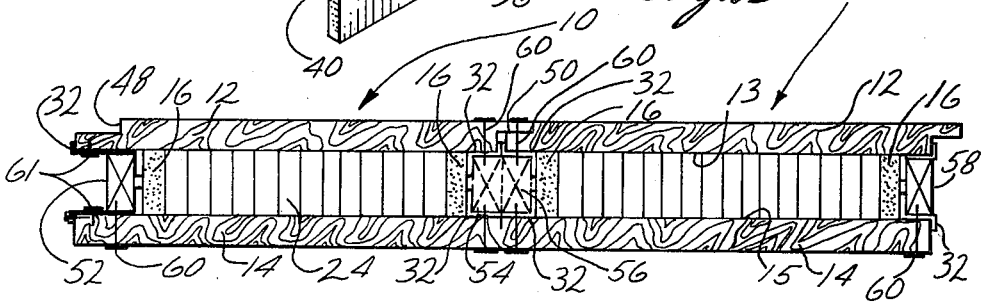
FIG. 3 is a top view in cross section of two vertically oriented composite panels secured to framing members.

The clip 32 (as best seen in FIG. 3) is held in place by means of conventional retaining nails 61, the shank portion of which passes through clip receiving bores 44 and 46. A retaining nail 61 through bore 46 is directed into an edge 20 or 21 of a panel, whereas a retaining nail 61 through bore 44 is directed into a face 13 of a corresponding panel. Although as described, the clips are held in place by retaining nails 61, it is to be understood that any one of a number of conventional securing methods, such as, the use of adhesives may be used in securing the clips to the composite panel.

In typical and conventional structural applications, the composite panel 10 forms a structural partition or wall between structural framing members. For example, in home construction, the framing members would be the conventional two-by-four wooden studs typically used in the construction of the home.

An example of the use of the composite panels 10 in a structural application is shown in the cross-sectional top view of FIG. 3. The composite panels 10 are oriented in a vertical plane for forming a structural wall. One of the panels, for example panel 12 of the composite panel 10, includes an outwardly facing L-shaped groove 48 along one edge of the panel, and an inwardly facing L-shaped groove 50 along the opposite edge of the panel 12. The directions, outwardly facing and inwardly facing, are referenced to the central core area 24 of the composite panel 10. It is understood that other complementary mating geometries such as tongue-in-groove may also be used as a suitable substitute for the L-shaped grooves shown in FIG. 3.

As shown in FIG. 3, two composite panels 10 are secured between framing members or studs 52, 54, 56 and 58. The studs may be the conventional two-by-four framing members previously described. In the example shown in FIG. 3, the length of the clip leg 38 is equal to the predetermined distance 19 shown in FIGS. 1 and 2 and is selected to accommodate a single framing member. Thus, as shown in FIG. 3, two framing members extend vertically between two composite panels at the vertical edges thereof. The clips 32 as shown in FIG. 3 provide a seat for a corresponding vertically oriented framing member, and the composite panels 10 are secured to the framing members by means of retaining nails 60 that are driven through the panels 12 and 14 and into the framing members. The retaining nails 60 are placed so that they do not encounter a clip 32 when the nail is being driven through the panels. It is also understood that the length of the clip leg 38 may be varied in accordance with the number of framing members accommodated.

Figure 4:
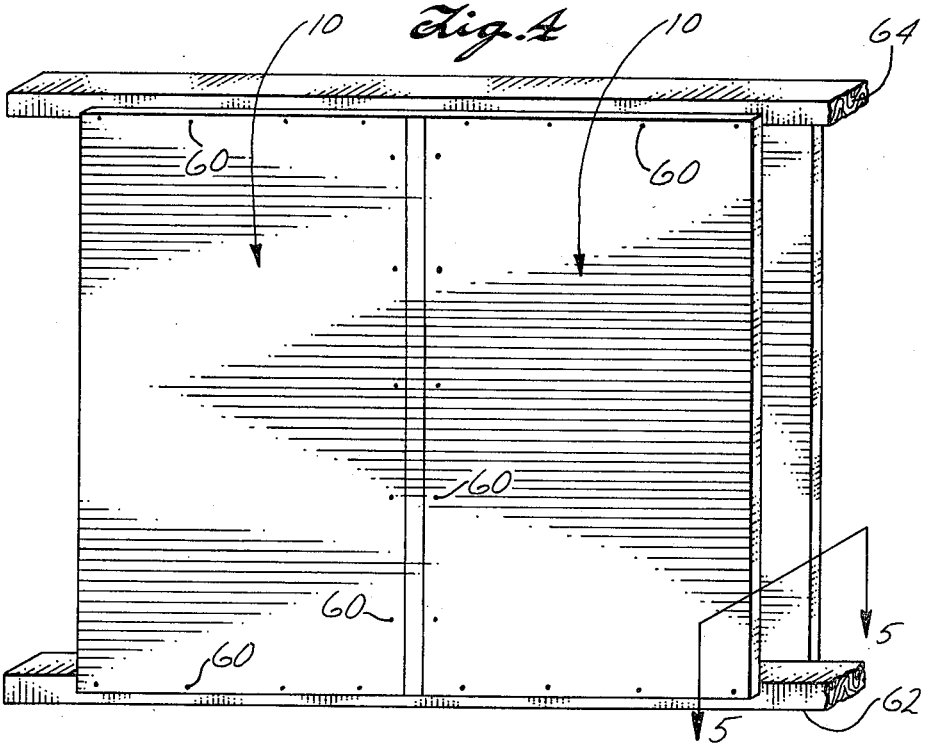
FIG. 4 is a perspective view of two vertically oriented composite panels secured between horizontal framing members.

The clips 32, as best shown in FIGS. 4 and 5, also provide a seat for a horizontally-oriented framing member. The clip thickness 37 serves to separate the vertical edges of the panels preferably about 1/16 inch. This separation compensates for panel expansion whether caused by moisture or temperature and minimizes the potential ejection of retaining nails due to panel expansion. Caulking material may be placed within the separation to provide for weatherproofing.

Referring to FIG. 4, there are shown two panels 10 vertically oriented and supported between horizontal framing members 62 and 64. The composite panels 10 are secured to the horizontal framing members 62 and 64 in much the same manner as previously described for securement to the vertical framing members, i.e., by means of retaining nails 60.

As shown in the cross-sectional view of FIG. 5, the clips 32 provide a load bearing element such that the loads carried by the composite panels 10 are transferred from the panels 10 to the horizontal framing members 62. The load-bearing capability of the clips 32 enhances the structural load-bearing capacity of the composite panels 10 over panels not having such clips. Additionally, the use of the clips 32 relaxes somewhat the necessity of the use of high-strength adhesives for adhering the panels 12 and 14 to the boundary strip 16.

Furthermore, the loads present in a structure comprising composite panels are transferred between the panels and the framing member by virtue of the clips 32.

In conventional building practice, the loads would be carried solely by the retaining nails. However, in the present invention, the clip bears a major portion of the loads, the loads being distributed throughout the clip. This load distribution reduces the loading on the retaining nails 60 since the clip transfers the loads directly to the panels 12 and 14 of a composite panel 10. The clip length 39 may be selected in accordance with the load carrying requirements selected for the composite panel 10. Thus, the greater the clip length 39, the greater the load carrying capacity of the composite panel. The clip distance 19 may also be selected to accommodate a number of different structural members.

The boundary strip 16 may be formed of rigid but elastically compressible material such as foam plastic. Preferably, the boundary strip 16 is formed of elastic material such that it will remain permanently compressed as a result of the panels 10 passing through pinch rollers. By virtue of the compressibility of the boundary strip, complete adhesive contact between the honeycomb upper edges 28 and lower edges 29 and the respective panel faces 13 and 15 occurs. Thus, when the boundary strip 16 is deformed, it attains essentially the same thickness as the core material (as measured between the panel faces).

Additionally, because the boundary strip deforms, it will conform to irregularities in the panel faces 13 and 15 and in combination with the sealing effects of the adhesive, the compressive force exerted by the panels on the boundary strip 16 provides a water-tight seal between the panel faces 13 and 15 and the boundary strip rendering the central core region 24 essentially impervious to moisture.

As shown in FIG. 5, the clips 32 are of the Z-shaped design previously described. It will be understood, however, that any one of a number of appropriate geometries for the clips may be used for load bearing and load transferring for transferring the loads on the composite panels to the corresponding framing members.

Referring now to FIGS. 6 and 7, there is shown one such alternate form of the clips 32. The clips 32 as shown in FIG. 6, are essentially U-shaped having a pair of parallel legs 134 and 136 depending from an interconnecting leg 138. The legs 134 and 136 have outwardly flaring (as viewed in FIG. 6) edges 140 and 142 respectively. The edges 140 and 142 are for abutting contact with the corresponding perimetrical edges of the panels 12 and 14. The distance 119 defined between the edges 140 and 142 and the interconnecting leg 138 equals the distance between the perimetrical edges of the panels 12 and 14 and the boundary strip 16. Each of the clip legs 134 and 136 has a plurality of barbs 143 that extend outwardly from the corresponding legs and are oriented to facilitate insertion of the clip 132 into the receiving seat formed by the panels 12 and 14 and the boundary strip 16.

Upon placement of the clips 132 into the corresponding seat, the outwardly pointing barbs 143 are directed inward into the respective panels 12 and 14 in a direction so as to oppose the removal of the clip from its corresponding seat. Although retaining nails may be used as in the case of the Z-shaped clip 32, the retention capability of the barbs is considered sufficient for anchoring the clips 132.

The clips 132 provide load carrying and load transferring from the panels 12 and 14 to the framing members 126 (see FIG. 7). The barbs 143 may be formed by any one of a number of conventional punching operations known in the metal-forming art. Although singly-pointing barbs 143 are illustrated in FIG. 6, it is undersood that any one of a number of pointed projections are appropriate, as are the barbs heretofore described.

Another such example of clips capable of use with composite panels 10 is shown in FIG. 8.

FIG. 8 is a cross-sectional view of a corner structure having two vertically standing composite panels 10. As shown in FIG. 8, the clips 232 provide load carrying and load transferring from the composite panels 10 to the framing members 262 and 263 respectively.

Preferably, clips 232 and the various shaped clips previously described are formed of a strong rigid material such as a metal, plastic or wood. Typical modes of manufacture for the clips includes press forming or extrusion. The clips may also be molded or formed by any of a number of suitable and conventional forming techniques. The clips are characterized in that they are relatively simple and readily installed in the composite panels. The clips may be formed of material sufficiently thin so as not to cause the panels 12 and 14 to be urged apart and thus bulge outward as the framing members are inserted in the corresponding seats. The clips have sufficient strength such that the framing members are held securely in place while the corresponding panels are nailed to such framing members.

The interior clip surfaces that come in contact with the framing members may be coated with a friction-reducing material such as "Teflon", silicon or other lubricants for aiding in the insertion of the framing members into the composite panels. A quality of the lubricant is that it does not bond to adhesive that may be used in the manufacture of the composite panels. Any adhesive that may accumulate on the clip may be easily removed and thus not interfere with the construction of a structure using the panels described herein.

It is to be understood that the use of retaining nails for securing the clips to the corresponding framing members is a securing expedient well known in the construction art. As an alternate to the nails, an adhesive may be placed on the clip surfaces that contact the composite panel for securing the clips to the panel.

A combinaion of the use of retaining nails and adhesives typically that are slow curing may be used between the framing members and the composite panels. The application of both nails and adhesives are preferable when the composite panel is used as flooring, or in the case where the composite panels are to be used as bearing walls in multiple-story structures.

Although the panel, as shown in FIG. 1, illustrates the use of a honeycomb material for the core, it is to be understood that any of a number of solid or rigid materials may be used. An example of such material is foam plastic.

The panel core may include insulation material preferably having a particulate composition so as to be capable of filling cores that are formed from honeycomb structures. The use of insulation increases the insulating property of the panel so that both structural and insulation properties are provided by the present invention.

While the basic principle of this invention has been herein illustrated along with one embodiment, it will be appreciated by those skilled in the art that variations in the disclosed arrangement both as to its details and as to the organization of such details may be made without departing from the spirit and scope thereof. For example, the composite panel may be formed for some applications such that the boundary strip is adjacent the edge of the panels so that the predetermined distance equals zero.

Accordingly, it is intended that the foregoing disclosure and the showings made in the drawings will be considered only as illustrative of the principles of the invention and not construed in a limiting sense.

What is claimed is:

1. A load bearing wall comprising:

a framework including top and bottom horizontal members joined by spaced vertical members, and wall panels extending between the horizontal and vertical members, each wall panel including a pair of solid rectangular panel sheets spaced apart by a distance slightly greater than the thickness of the framework members, the sheets overlapping the framework members, core means located between and bonded to the adjacent surfaces of the panel sheets to secure the sheets together, a boundary sealing strip of compressible material having a normal thickness greater than the spacing between the panel sheets maintained by the core means, the boundary strip being compressed between and bonded to the panel sheets and extending around the perimeter of the panel sheets but offset from the edges of the panel sheets to provide space for the frame members to fit between the panel sheets, and a plurality of clips positioned at spaced intervals around the perimeter of the respective panel sheets, each clip having two parallel portions joined by a connecting portion, one parallel portion of each clip engaging the edge of a panel sheet, the other parallel portion lying against the boundary strip, and the connecting portion engaging the inner surface of the panel sheet, said other parallel portion of the clips engaging a frame member to transfer any load extending parallel to the panel surface between the panel and the framework.

2. The panel according to claim 1 wherein the core means has a general honeycomb shape, the honeycomb having a plurality of wall oriented essentially transverse to the first faces of the panels, the honeycomb walls, having a length defined between the first faces of the panels, said length being marginally less than the thickness of the boundary strip, the panel faces thereby in the region of the central core area being urged relatively closer together, the first faces of the panels exerting thereby a compressive force on the boundary strip means.

3. The panel according to claim 2 wherein the boundary strip is compressively and elastically deformable such that application of compressive forces causes the boundary strip to deform wherein said boundary strip attains a thickness equal to the length of the honeycomb.

4. The panel according to claim 3 wherein the panels have an uneven countour and upon deformation the boundary strip assumes the contour of the panels along the region of contact between the boundary strip and the panels.

5. The panel according to claim 2 wherein the panels are bonded to the boundary strip by adhesive means and the compressive force provided by the inner faces of the panel sheets on the boundary strip and adhesive means to provide a water-tight seal between the first faces of the panels and the boundary strip.

6. The panel according to claim 1 wherein the clips are capable of bearing structural loads and are selected from the group consisting of metal, plastic and wood.

7. The panel according to claim 1 further comprising insulation means disposed within the central core area for providing an insulating panel.

8. The panel according to claim 1 wherein at least two composite panels are capable of abutting relation along a respective edge thereof and wherein at least one panel of one abutting composite panel has a cut-out along one edge thereof for engaging a corresponding complementary cut-out in a panel of the other abutting composite panel.

9. The panel according to claim 1 wherein the panels are formed from plywood.

10. The panels according to claim 1 wherein the panels are formed from sheet metal.

11. The panels according to claim 1 wherein the panels are formed from gypsum board.

* * * * *